US007993169B1

(12) United States Patent
Hoxha

(10) Patent No.: US 7,993,169 B1
(45) Date of Patent: Aug. 9, 2011

(54) CONNECTOR ASSEMBLY

(76) Inventor: Vladimir Hoxha, Toronto (CA)

( * ) Notice: Subject to any disclaimer, the term of this patent is extended or adjusted under 35 U.S.C. 154(b) by 0 days.

(21) Appl. No.: 12/766,527

(22) Filed: Apr. 23, 2010

(51) Int. Cl.
*H01R 11/01* (2006.01)

(52) U.S. Cl. ..... 439/781; 439/783

(58) Field of Classification Search ..... 439/81, 439/782, 783, 790, 791, 794, 807, 815
See application file for complete search history.

(56) References Cited

U.S. PATENT DOCUMENTS

| | | | | | |
|---|---|---|---|---|---|
| 1,979,091 | A | * | 10/1934 | Alsaker et al. | 439/782 |
| 3,026,497 | A | * | 3/1962 | Myers et al. | 439/781 |
| 3,425,028 | A | * | 1/1969 | Neaderland | 439/723 |
| 3,924,920 | A | * | 12/1975 | Moscioni et al. | 439/781 |
| 4,384,753 | A | * | 5/1983 | Mixon, Jr. | 439/92 |
| 4,502,743 | A | * | 3/1985 | Ziegler | 439/98 |
| 4,764,131 | A | * | 8/1988 | Beinhaur | 439/781 |
| 4,915,653 | A | * | 4/1990 | Mair | 439/781 |
| 5,092,797 | A | * | 3/1992 | Cole et al. | 439/783 |
| 5,244,422 | A | | 9/1993 | Laricchia | |
| 5,340,335 | A | * | 8/1994 | Haun | 439/783 |
| 5,423,699 | A | * | 6/1995 | Johnson | 439/783 |
| 5,692,930 | A | * | 12/1997 | Garver et al. | 439/781 |
| 6,004,165 | A | | 12/1999 | Dinh et al. | |
| 6,045,414 | A | | 4/2000 | DeFrance | |
| 6,116,969 | A | * | 9/2000 | Piriz | 439/783 |
| 6,120,334 | A | | 9/2000 | Timsit et al. | |
| 6,517,391 | B1 | | 2/2003 | Chadbourne | |
| 6,851,262 | B1 | | 2/2005 | Gregory et al. | |
| 6,997,739 | B2 | | 2/2006 | Hoxha | |
| 7,011,552 | B2 | | 3/2006 | Hoxha | |
| 7,182,653 | B1 | | 2/2007 | Hoxha | |
| 7,247,061 | B2 | | 7/2007 | Hoxha et al. | |
| 7,387,546 | B2 | | 6/2008 | Copper et al. | |
| D599,184 | S | | 9/2009 | Johnson et al. | |
| 2010/0015862 | A1 | | 1/2010 | Gregrory et al. | |

OTHER PUBLICATIONS

J.D. Sprecher et al., "Wedge Connector Technology in Power Utility Applications", AMP Journal of Technology, Jun. 1996, vol. 5, pp. 4-13.

R.S. Timsit et al., "Energy Losses in Power Tap-Connectors", IEEE, 1998, 9819-C-TPC-6, pp. 285-296.

John J. Schindler et al., "Mechanical and Electrical Contact Properties of Wedge-Connectors", IEEE, Sep. 1996, Part A, vol. 19, No. 3, pp. 287-294.

Roland S. Timsit, "Fired Wedge Tap Connectors Offer Benefits in Electrical Distribution Systems", Electric Light and Power, PennWell Publication, Dec. 1997, 3 pages.

R.S. Timsit, "The Technology of High-Power Connections: A Review", Timron Scientific Consulting Inc., 16 pages.

* cited by examiner

*Primary Examiner* — Ross N Gushi
(74) *Attorney, Agent, or Firm* — Jenna L. Wilson; Dimock Stratton LLP

(57) ABSTRACT

A connector assembly for joining bare or insulated conductors includes a first member and a second member which cooperate to act as clamps. The first member has two beams connected by a body and tabs extending from the center of the body substantially parallel to the two beams. The distal end of the beams each have a receptacle for receiving a conductor. The cross-section of the first member may be Sigma- or E-shaped. The second member has two contact planes, each facing a receptacle, and has a body facing surface that complements the shape of the inner surface of the body that it engages, including a groove for receiving the tabs. The second member is guided by the tabs of the first member when moved by operation of a fastener from an unloaded position, where the second member engages the body, to a loaded position in which the second member is pushed away from the body and holds the conductors securely in place in the receptacles. This connector assembly is adaptable for hot stick applications.

21 Claims, 8 Drawing Sheets

FIG. 12A
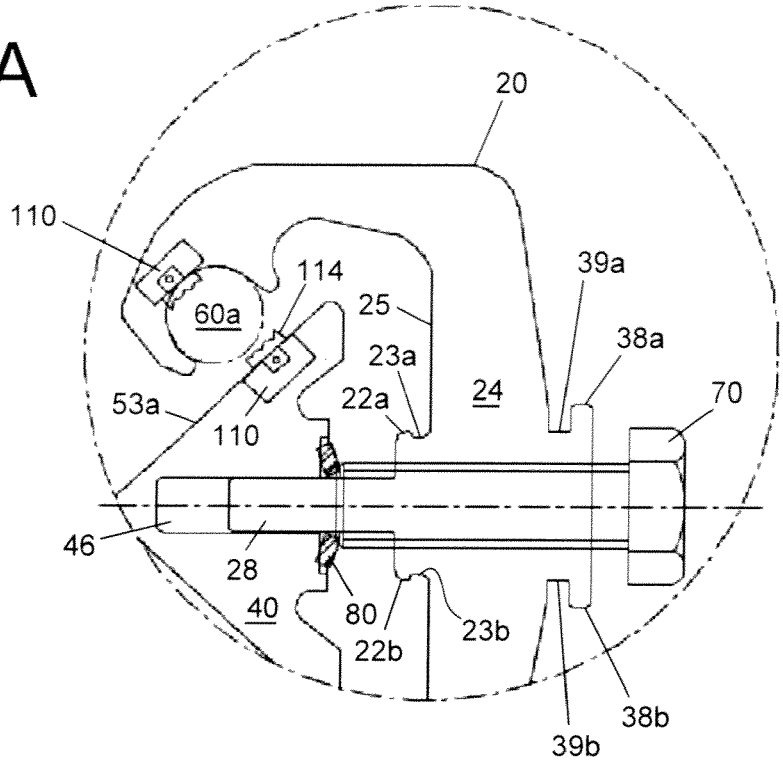
FIG. 12B
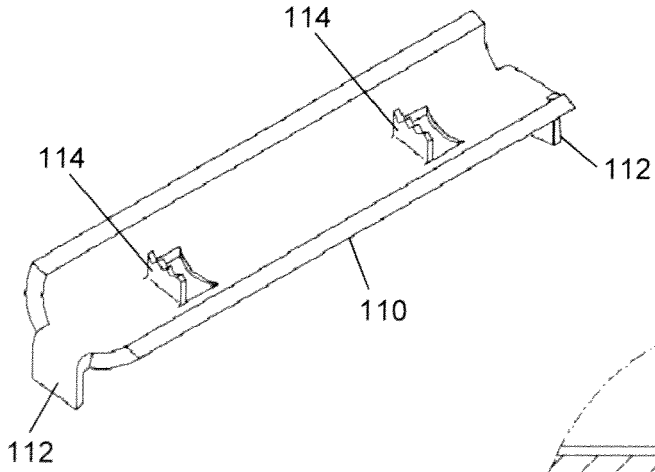
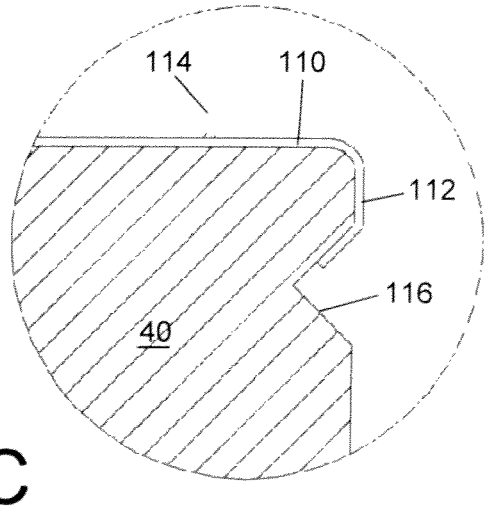
FIG. 12C

CONNECTOR ASSEMBLY

FIELD OF THE INVENTION

The present invention generally relates to electrical tap connectors.

BACKGROUND OF THE INVENTION

In electrical power systems, it is often necessary to join two or more conductors in an electrically conductive path. One type of electrical connector for joining conductors such as cables is a wedge tap connector comprising a wedge and a C-shaped member formed of electrically conductive materials. Wedge tap connectors join electrical cables mechanically by forcing a wedge with channels on its opposing sides between a main power conductor and a tap conductor over which is hooked the C-shaped member. The conductors are thereby clamped between the channels in the wedge member and the ends of the C-shaped member. Mechanical fastness is achieved by inserting the wedge between the two cables with sufficient force to cause elasto-plastic deformation of the C-shaped member. A special tool, such as a ram tool actuated by a gunpowder explosion, is therefore typically required to properly insert the wedge. A disadvantage of this type of wedge connector is that birdcage strand separation in the cable conductor may occur when the wedge is inserted. Further, several different-sized C-shaped members or wedge sizes may be required to accommodate a range of cable conductor sizes.

BRIEF DESCRIPTION OF THE DRAWINGS

In drawings which illustrate by way of example only a preferred embodiment of the invention.

FIG. 12A is a partial cross-sectional view of a connector assembly provided with insulation piercing bridges.

FIG. 12B is a perspective view of an insulation piercing bridge for use in a channel of the assembly of FIG. 12A.

FIG. 12C is a partial cross-sectional view of a second member provided with an insulation piercing bridge.

DETAILED DESCRIPTION OF THE INVENTION

A connector assembly for joining bare or insulated conductors is provided that has a first member and a second member which cooperate to act as clamps for the conductors. The first member has two beams connected by a body and at least one structural portion for aligning and guiding the first and second members in relation to one another, such as tabs extending from the centre of the body substantially parallel to the two beams. The distal end of the beams, each have a receptacle or channel for receiving a conductor. The second member has two mating faces, each facing a receptacle, and has a body facing surface that complements the shape of the inner surface of the body that it engages, including at least one structural portion adapted to mate with the alignment portion on the first member, such as a groove for receiving the tabs. The second member may be moved by operation of a fastener from an unloaded position, where the second member engages the body, to a loaded position in which the second member is away from the body and holds the conductors securely in place against the receptacles.

Figure 1:
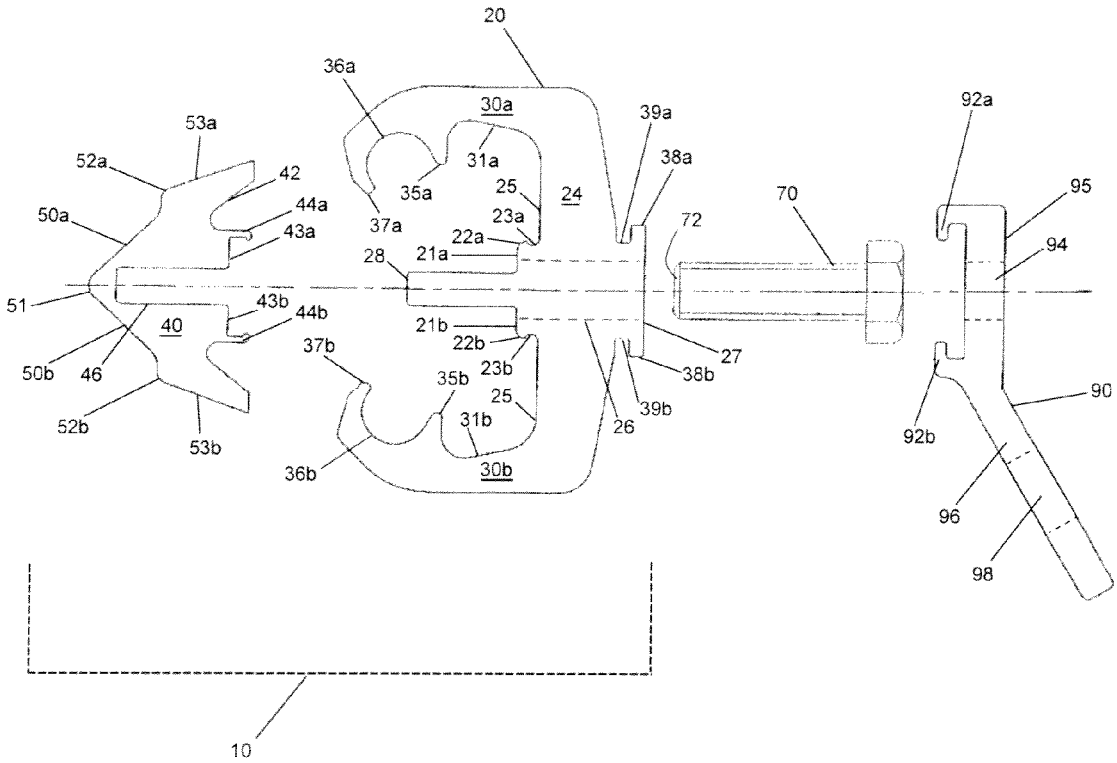
FIG. 1 is a cross-sectional exploded view of an embodiment of a connector assembly with a fastener and attachment tool.

FIG. 1 illustrates a first embodiment of a connector assembly 10. Generally, the connector assembly 10 comprises a first member 20 and a cooperating second member 40. The first member 20 and second member 40 may be joined by means of a fastener 70, such that conductors held in the assembly 10 (not shown in FIG. 1) are joined both mechanically and electrically.

Figure 2:
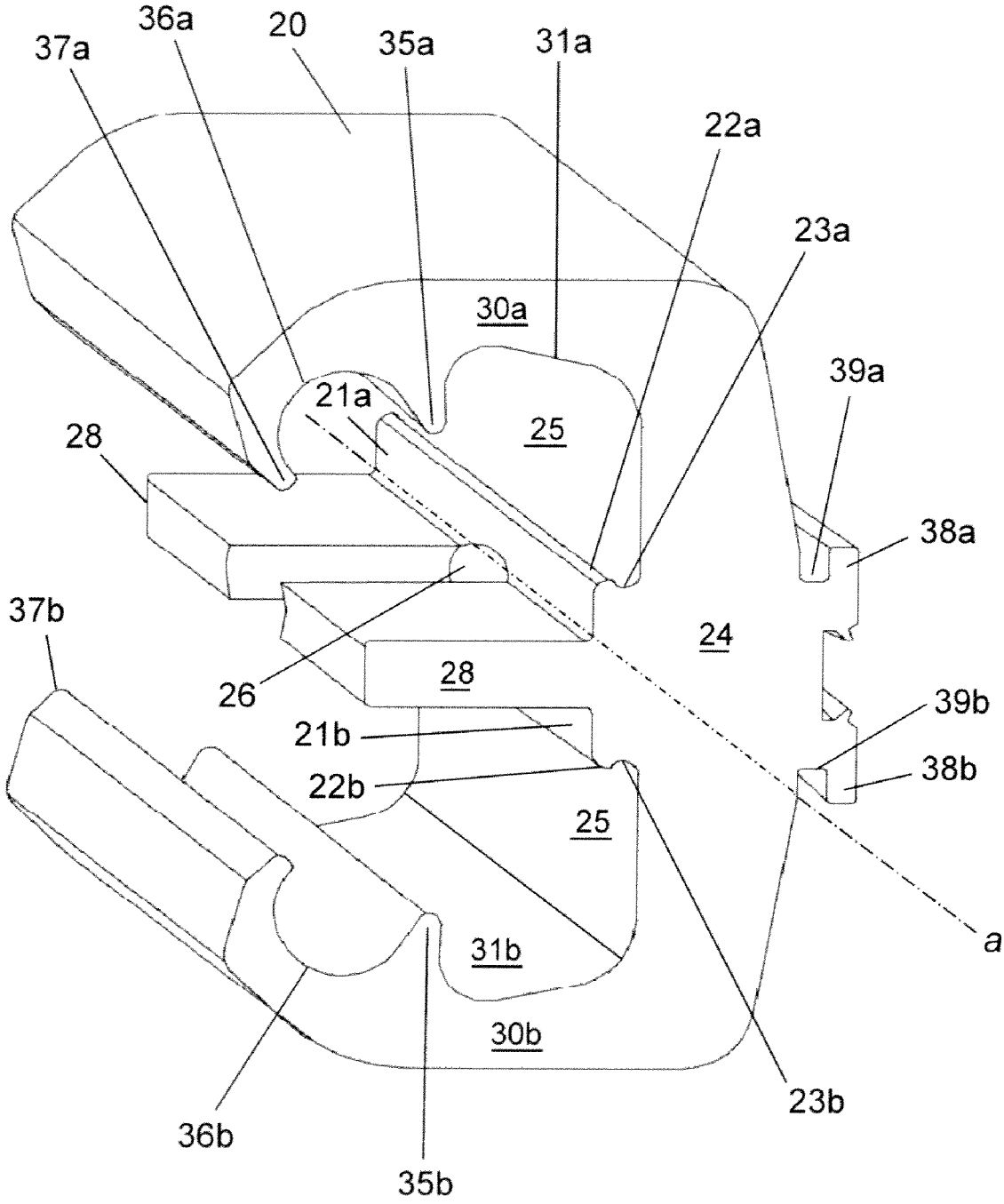
FIG. 2 is a perspective view of a first member of the connector assembly of FIG. 1.

The first member 20 is provided with two beams 30*a*, 30*b* extending from a body 24. The beams 30*a*, 30*b* may each extend from opposite ends of the body 24, or proximate to the opposite ends of the body 24. The beams 30*a*, 30*b* generally extend from the same face of the body 24 to define an interior surface 25 of the body, which is adjacent to an interior face 31*a*, 31*b* corresponding to the beams 30*a*, 30*b*. Each beam 30*a*, 30*b* may be provided with a corresponding channel 36*a*, 36*b* generally defined on the interior face 31*a*, 31*b* of each beam 30*a*, 30*b* for receiving conductors. As the conductors may have generally circular cross-sections, the channels 36*a*, 36*b* may be provided with a generally curved profile, such as a semicircular or arcuate contour, to receive the conductor. In the embodiments illustrated herein, each channel 36*a*, 36*b* in each corresponding beam 30*a*, 30*b* has a substantially identical profile, although each channel 36*a*, 36*b* may have a different profile to suit a differently sized or shaped conductor intended to fit within that specific channel. The channels 36*a*, 36*b* may be formed integrally with each beam 30*a*, 30*b* at or near a distal end of the beam 30*a*, 30*b*. The contour of each channel 36*a*, 36*b* may be defined in part by corresponding first and second stops 35*a*, 37*a* and 35*b*, 37*b* respectively, which also assist in retaining the conductor in place when the connector assembly 10 is assembled. As illustrated in the within embodiments, the first member 20 has a generally uniform profile along a longitudinal axis a of the member 20, as can be seen in FIG. 2.

A bore 26 is provided through the body 24 (shown in phantom in FIG. 1), generally located at or around a central portion of the body 24, for receiving a fastener 70. The bore is generally oriented perpendicular to the longitudinal axis a of the first member 20, and may be generally perpendicular to the plane of the body 24. If the fastener is a threaded bolt or other threaded fastening means, the wall of the bore 26 may by provided with complementary threads such that the fastener 70 may be securely and removably fastened to the first member 20.

An inner surface 25 of the first member 20 may be shaped to fit the second member 40, discussed below. The inner surface 25 may also be provided with one or more tabs 28. The tabs 28 extend from the inner surface 25 substantially in the same direction as the beams 30*a*, 30*b*. The tabs 28 may be longitudinally aligned along the length of the first member 20, and may flank either side of the bore 26, as can be seen more clearly in FIG. 2. Thus, a cross-section of the first member 20 may be seen to resemble a Sigma (Σ) or E shape.

The inner face 25 of the first member 20 may further be provided with mating elements that may be used to facilitate assembly with the second member 40, as described below. The first member 20 may be provided with one or more alignment shelves 22*a*, 22*b*, each defining a corresponding recess 23*a*, 23*b* between the shelf 22*a*, 22*b* and the inner face 25. The shelves 22*a*, 22*b* may be formed integrally with the body 24; thus, a center portion of the body 24 may be thickened, providing a longer bore 26 therethrough, and a raised inner surface 21*a*, 21*b* that would abut the second member 40. In embodiments such as those illustrated in FIGS. 7, 8 and 10, which do not have alignment shelves 22*a*, 22*b*, portions 21*c*, 21*d* of the inner surface of the body 24 would abut the second member 40.

An external face of the body 24 may be provided with one or more flanges 38*a*, 38*b* disposed on either side of the bore 26. Each flange 38*a*, 38*b* defines a corresponding recess 39*a*, 39*b* shaped to receive a hook 92*a*, 92*b* of a hot stick tab 90, also shown in FIG. 1. The hot stick tab 90 may thus be slid into place over the flange or flanges 38*a*, 38*b*, and temporarily secured in place with an adhesive or any other method known in the art between the surfaces of the hook 92*a*, 92*b* and flanges 38*a*, 38*b*.

Again with reference to FIG. 1, the second member 40 is provided with a body facing surface 42, which cooperates with the inner face 25 of the first member 20. In the embodiment of FIG. 1, the body facing surface 42 may be provided with hooks 44*a*, 44*b* for latching in the corresponding recesses 23*a*, 23*b* of the first member 20. The second member 40 is further provided with a slot 46 shaped to receive the tab or tabs 28 of the first member 20. In the illustrated embodiments, a single through slot 46 is provided in the second member 40, particularly if the second member 40 is formed by extrusion. The slot 46 may instead comprise closed slots or grooves. The slot 46 is defined in the body facing surface 42 of the second member 40, such that the body facing surface 42 comprises abutment faces 43*a*, 43*b* which abut the inner surface 25 of the first member 20 at raised inner surfaces 21*a*, 21*b* or portions 21*c*, 21*d* of the inner surface 25.

As can be seen in the illustrated embodiments, the second member 40 may have a substantially wedge-shaped or arrow-shaped cross-section, with contact planes 53*a*, 53*b* leading to guide planes 50*a*, 50*b*, the guide planes 50*a*, 50*b* meeting at a nose 51, which may be rounded, substantially flat, or pointed. A shoulder 52*a*, 52*b* may be provided at the transition between each of the guide planes 50*a*, 50*b* and its related contact plane 53*a*, 53*b*.

Figure 8:
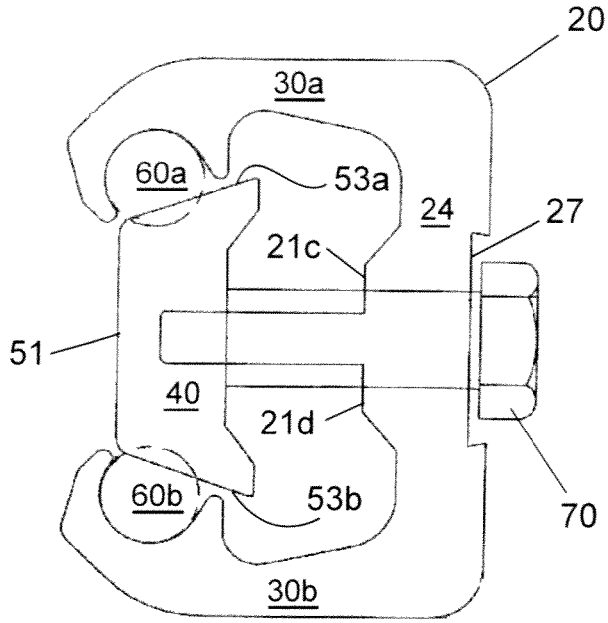
FIG. 8 is a cross-sectional view of a further embodiment of a connector assembly and fastener.

In another exemplary embodiment, as can be seen in FIG. 8, guiding planes 50*a*, 50*b* as in FIG. 1 need not be provided and the nose 51 of the second member 40 may be substantially flat. Also in FIG. 8, an external surface 27 of the body 24 of the first member 20 is provided with a recess for receiving the head of the fastener 70 and/or the hooks 92*a*, 92*b* of the hot stick tab 90. The recess may have a depth sufficient to allow the head of the fastener 70 and/or the hooks 92*a*, 92*b* of the hot stick tab 90 to be flush with the body 24.

Figure 3:
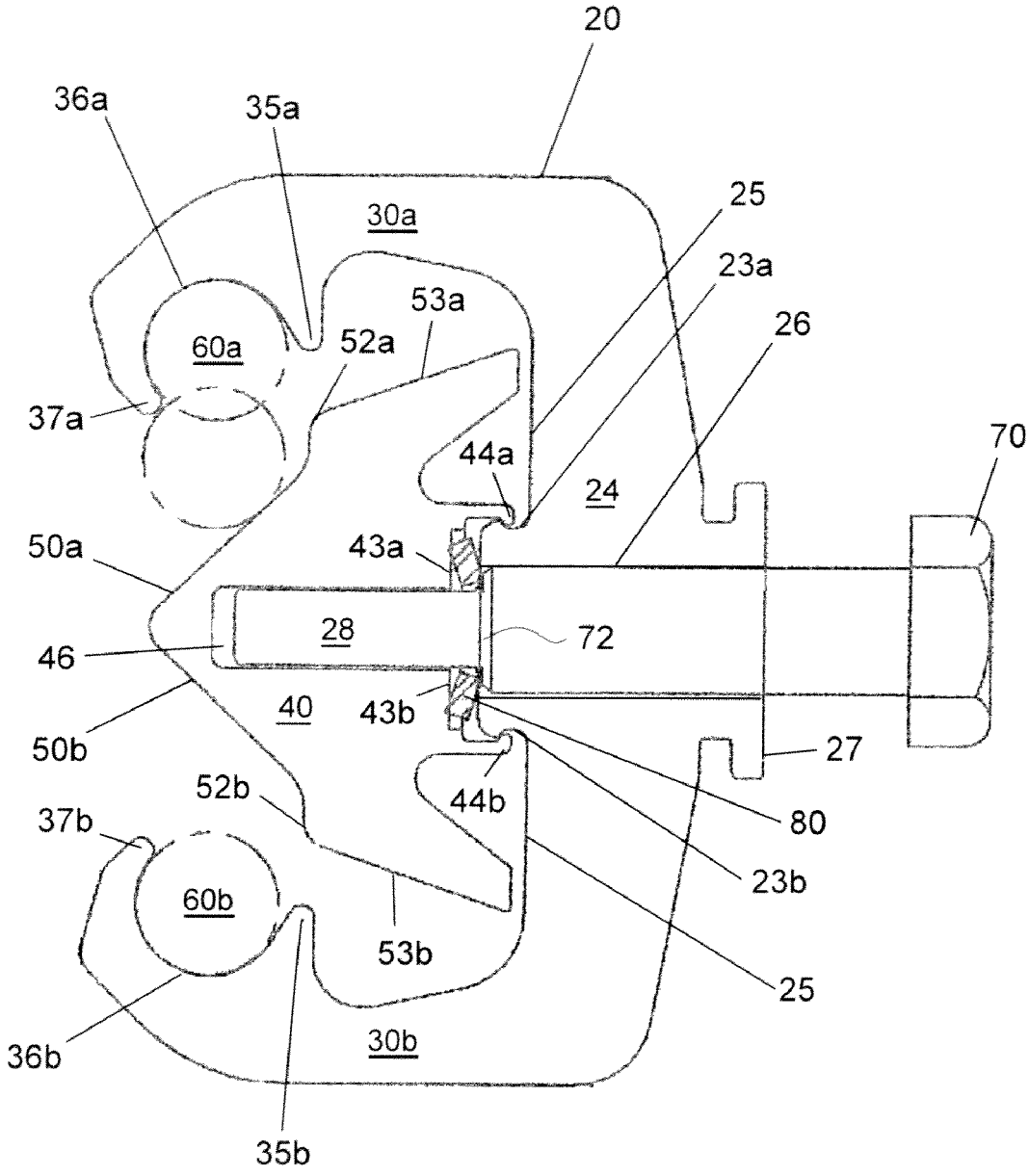
FIG. 3 is a cross-sectional view of the connector assembly of claim 1 with a fastener and in an unloaded position.
Figure 4:
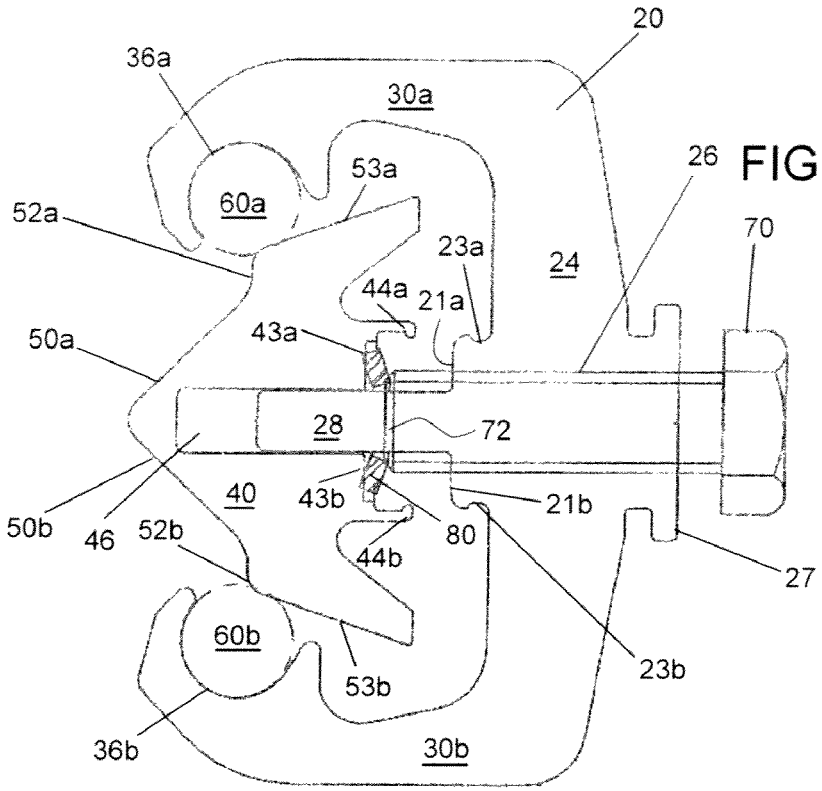
FIG. 4 is a cross-sectional view of the connector assembly of claim 1 with a fastener and in a partially loaded position.
Figure 5:
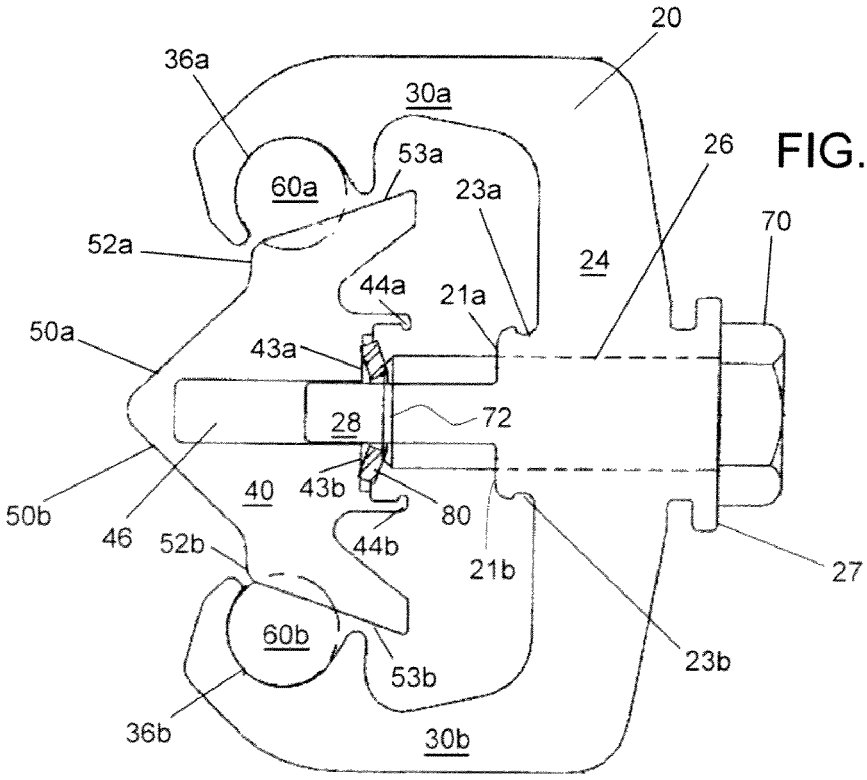
FIG. 5 is a cross-sectional view of the connector assembly of claim 1 with a fastener and in a loaded position.
Figure 7:
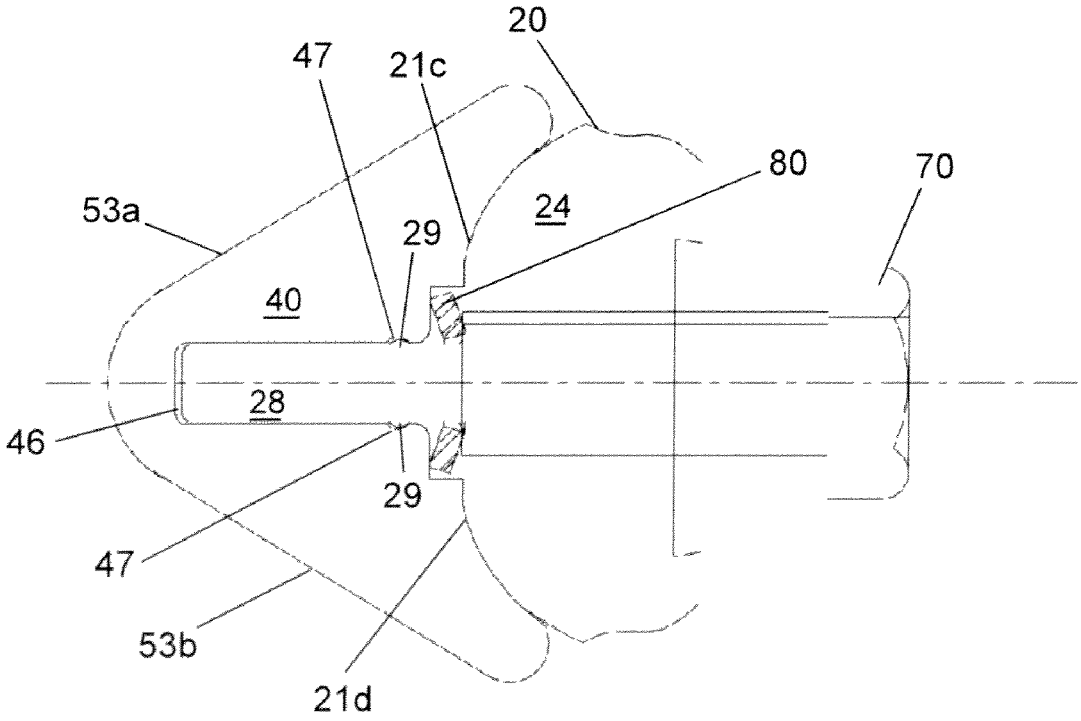
FIG. 7 is a partial cross-sectional view of a further embodiment of a connector assembly.

The assembly of the first and second members 20, 40 of the connector assembly 10, with conductors, is shown in FIGS. 3 to 5. FIG. 3 illustrates the assembly 10 in an unloaded or partially loaded position. The first and second members 20, 40 may be provided preassembled in an unloaded state to facilitate handling. The second member 40 may be slide-fit onto the first member 20 so that the hooks 44*a*, 44*b* of the second member 40 are received in the recesses 23*a*, 23*b* of the first member 20; or, if the second member is provided in a sufficiently resilient material, it may be snap-fit onto the first member 20. The first and the second members 20, 40 may be provided together in this manner, optionally or alternatively held together with a light adhesive to prevent the members from separating during shipment or handling. Additionally or alternatively, the first and second members 20, 40 may be provided with a locking mechanism as shown in FIG. 7. The tabs 28 of the first member 20 may be provided with at least one rib 29 extending outwardly from the tab 28. A corresponding receiving furrow 47 is provided within the slot 46 in the second member 40. The first member 20 may thus be provided in a material with sufficient resilience such that the first member 20 may be snap-fit into the second member 40; however, as the first and second members 20, 40 may be manufactured using extrusion techniques, the furrow 47 may extend throughout the entire length of the second member 40 and the rib 29 may extend along the entire length of the first member 20. The first member 20 may therefore be slidingly engaged with the second member 40 rather than snap-fit. In other embodiments, the location of the ridge 29 and the furrow 47 may be reversed (i.e., the furrow may be provided on the second member 40 and the ridge provided on the first member 20), or the ridge and furrow may be provided in other positions on each part, for example on the inner face 25 and the mating face 23 of the first and second members 20, 40 respectively. Thus, the hooks 44*a*, 44*b* and recesses 23*a*, 23*b* shown in FIG. 1 may be omitted in this embodiment.

When the first and second members 20, 40 are assembled, the abutment faces 43*a*, 43*b* may not be in contact with any part of the inner face of the first member 20. A spring member 80, such as a spring washer, disc spring, or Belleville washer, may be provided, mounted between the first member 20 and the second member 40. The addition of the spring member, particularly a washer having spring-like characteristics such as the Belleville washer, provides dampening of vibrations in the connector assembly 10 once assembled, and may assist in preventing the assembly and fastener 70 from becoming disconnected or loosened due to vibrations transmitted from the conductor 60*a*, 60*b* and/or expansions or contractions in the conductor 60*a*, 60*b* the first and second members 20, 40 or the fastener 70 due to changes in temperature or other environmental conditions. The spring member 80 in this embodiment may be in contact with the first member 20 and/or the tip 72 of the fastener 70 and the abutment surfaces 43*a*, 43*b* of the second member 40.

In this assembly, the tabs 28 extend into, and are received by, the slot 46 of the second member 40. A fastener 70, such as a threaded bolt, may be provided with the assembly 10. The bolt extends into the bore 26, and may abut the spring member 80. If the assembly 10 is preassembled in the unloaded state with hooks 44*a*, 44*b* and recesses 23*a*, 23*b* or ribs 29 and furrows 47 holding the first member and the second member together, and with a spring member 80 between the first and second members 20, 40, the fastener 70 may be advanced through the bore 26 to abut the spring member 80 with sufficient force to prevent the second member 40 from sliding apart from the first member 20 in the direction of longitudinal axis α, but with less force than would cause the hooks 44*a*, 44*b* and recesses 23*a*, 23*b* or ribs 29 and furrows 47 to become dislodged. In such an embodiment, the fastener 70, the spring member 80, and the first and second members 20, 40 may be provided as a preassembled assembly 10 with no free or loose parts. The bolt may have a diameter greater than the width of the slot 46, and thus does not extend into the slot 46 of the second member 40, but rather pushes the second member 40 at the abutment surfaces 43*a*, 43*b* when it extends through and beyond the bore 26. The guide planes 50*a*, 50*b* of the second member 40 are generally oriented to face a corresponding beam 30*a*, 30*b*, and in particular to face a corresponding channel 36*a*, 36*b*. When the assembly is in an unloaded position, such as shown in FIG. 3, a conductor 60*a*, 60*b* may be inserted into each of the channels 36*a*, 36*b*, guided by the guide planes 50*a*, 50*b* and possibly also the shoulders 52*a*, 52*b*. The overall shape of the guide planes 50*a*, 50*b* facilitates insertion of the conductors 60*a*, 60*b*, since in the unloaded position, the space defined between the guide planes 50*a* or 50*b* and the corresponding beam of the first member 30*a*, 30*b* easily admits the conductors 60*a*, 60*b*.

To hold the conductors 60*a*, 60*b* in place, the connector assembly 10 may be placed in a partially loaded position shown in FIG. 4, which is an intermediate state between the unloaded position of FIG. 3 and a loaded position, shown in FIG. 5. As can be seen in FIG. 4, the fastener 70 is advanced through the bore 26 to extend through and beyond the body 24, to push the spring member 80, and/or the abutment surfaces 43*a*, 43*b* directly where a spring member 80 is not present, away from the inner face 25 of the first member 20. For example, if the fastener 70 is a threaded bolt, tightening the bolt will advance the bolt through the bore 26, cause the tip 72 of the bolt to be partially embedded in the spring member 80, and cause the bolt to push the spring member 80, and the spring member 80 to push the second member 40 away from the inner face 25 of the first member 20, as shown in FIGS. 3 to 5. The hooks 44*a*, 44*b* of the second member 40 may therefore be dislodged from the recesses 23*a*, 23*b* of the first member 20, and the contact planes 53*a*, 53*b* of the second member 40 advanced towards the channels 36*a*, 36*b* and the conductors 60*a*, 60*b* therein. The space defined within the slot 46 of the second member 40 is increased as the tabs 28 recede from the second member 40. As the second member 40 is advanced, the contact planes 53*a*, 53*b* will make contact with the conductors 60*a*, 60*b*. Strand separation may be prevented or minimized by ensuring that contact is made by the contact planes 53*a*, 53*b* and not the shoulders 52*a*, 52*b*.

Further advancement of the bolt from the partially loaded state will put the same assembly into a loaded position, shown in FIG. 5, in which the conductors 60*a*, 60*b* are fully engaged in the assembly 10. The conductors 60*a*, 60*b* are retained within the channel by the contact planes 53*a*, 53*b*. When sufficient force is exerted by the second member 40 on the conductors 60*a*, 60*b* to retain the conductors 60*a*, 60*b* in their respective channel, the beams 30*a*, 30*b* may be slightly deflected. Each beam 30*a*, 30*b* of the first member 20 and the corresponding contact planes 53*a*, 53*b* of the second member 40 effectively operate as a separate clamp for their respective conductor 60*a*, 60*b* as the deflection of each beam 30*a* or 30*b* is independent of the deflection of the other 30*a* or 30*b*.

Figure 9:
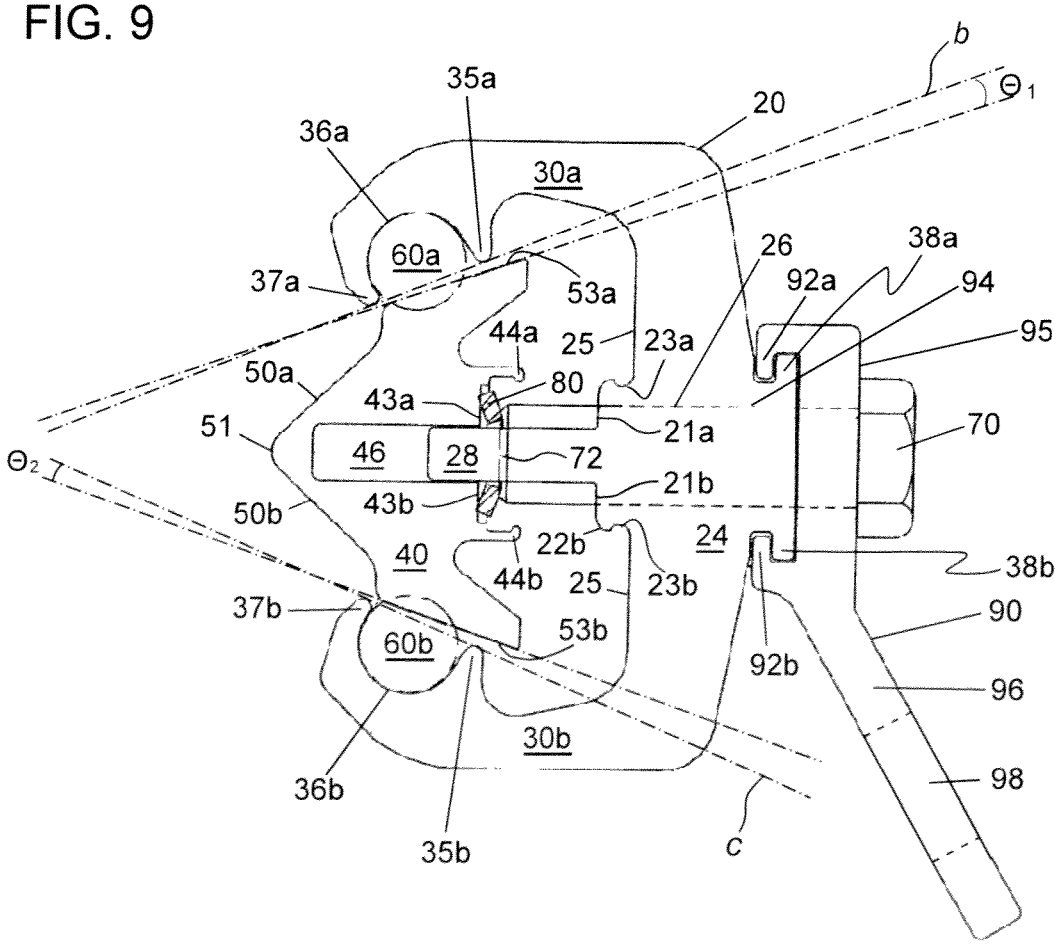
FIG. 9 is a cross-sectional view of still a further embodiment of a connector assembly, fastener, and hot stick attachment.

As illustrated in FIG. 9, it can be seen that the contact plane 53*a*, 53*b* thus defines angles $f_1$, $\theta_2$ with a plane b, c of the beams 30*a*, 30*b* of the first member 20. The plane b of the beam 30*a* may be notionally defined as the plane touching the first and second stops 35*a*, 37*a*, and the plane c of the beam 30*b* defined as the plane touching the first and second stops 35*b*, 37*b*. The angles $\theta_1$, $\theta_2$ are generally substantially equal when the conductors 60*a*, 60*b* are substantially the same dimension or within the designed range of accommodation.

As is well known in the art, sufficient wiping is important for removal of a non-conductive oxide film that may be present on aluminum and copper conductors, as this film hinders the creation and maintenance of a conductive path between conductors and a connector. However, excessive wiping causes strand separation. In the embodiments herein, wiping may be controlled by adjusting the angles $\theta_1$ or $\theta_2$, and also by limiting the distance across the contact plane 53*a*, 53*b* over which the conductor 60*a*, 60*b* is in contact with the contact plane 53*a*, 53*b* as the second member 40 is advanced from the partially loaded position to the loaded position. The distance over which the conductor 60*a*, 60*b* is in contact with the contact plane 53*a*, 53*b* as the second member 40 is advanced may be controlled by limiting the length of the contact plane 53*a*, 53*b* and/or by limiting the distance traveled by the second member 40 while the conductor 60*a*, 60*b* is in contact with the contact plane 53*a*, 53*b*.

To this end, the length of the fastener 70 may be selected such that when the connector assembly is in its loaded position, the head of the fastener 70 abuts the outer surface 27 of the body 24. The travelling distance of the second member 40 is therefore limited by the length of the fastener 70, which may assist in controlling wiping and may also assist in preventing overtorque. Furthermore, no special wrenches or tools are therefore required to control the torque applied to the fastener 70.

Thus, the first member 20 and the second member 40 provide an assembly 10 for electro-mechanically connecting two conductors, the first member 20 comprising a first beam 30*a* and a second beam 30*b*, a first face 31*a*, 31*b* of each of the first beam 30*a* and second beam 30*b* being provided with a corresponding channel 36*a*, 36*b* for receiving a conductor 60*a*, 60*b*, wherein each of the first beam 30*a* and second beam 30*b* extends from a first face 25 of a body 24 of the first member 20 such that the first face 25 of the body 24 is adjacent the first face 31*a*, 31*b* of each of the first beam 30*a* and the second beam 30*b*, and wherein the first face 31*a* of the first beam 30*a* and the first face 31*b* of the second beam 30*b* face are oriented to substantially face each other, and at least one first alignment portion, such as tabs 28 extending from the centre of the body 24 substantially parallel to the two beams 30*a*, 30*b*, for guiding an electrically conductive second member 40, the second member 40 comprising at least one second alignment portion, such as a groove 46 for receiving the tabs 28, adapted to cooperate with the at least one first alignment portion, a body facing surface 42, a first channel facing surface 53*a* and a second channel facing surface 53*b*, wherein when at least a portion of the at least one alignment portion is at least partially mated with the at least one second alignment portion, the second member 40 is movable between an unloaded and a loaded position, wherein in the unloaded position the body facing surface 42 of the second member is proximate to the first face 25 of the body 24, and in the loaded position the body facing surface 42 of the second member 40 is spaced apart from the first face 25 of the body 24 such that in the loaded position, a conductor 60*a* disposed in the channel 36*a* of the first beam 30*a* is retained in said channel 36*a* by the first channel facing surface 53*a* and a conductor 60*b* disposed in the channel 36*b* of the second beam 30*b* is retained in said channel 36*b* by the second channel facing surface 53*b*. The second member 40 may be made movable from an unloaded position to a loaded position by providing a bore 26 for receiving a fastener, such as a bolt 70, in the first member 20, the bore 26 extending from the first face 25 of the body 24 to an opposing face 27 of the body 24. The second member 40 may be moved by inserting the fastener in the bore 26 from the opposing face 27 of the body 24 and advancing the fastener in the bore 26 such that force is applied by a tip of the fastener (e.g., the tip 72 of the bolt 70) onto the body facing surface 42 of the second member 40, and the first channel facing surface 53*a* and second channel facing surface 53*b* are advanced towards the channel 36*a*, 36*b* of the first beam 30*a* and the second beam 30*b*, respectively. In some embodiments, a spring member 80 may be provided between the head of the bolt 70 and the opposing face 27 of the body and/or between the tip of the fastener and the body facing surface 42.

The first and the second members 20, 40 may be manufactured by extrusion of a conductive material. A suitable material may have high ultimate tensile strength, high yield strength, high elongation, high conductivity and be highly resistant to corrosion. An example of an appropriate material is aluminum alloy 6061-T6. To reduce the number of dies required for extrusion of the first member 20, the first member may be extruded such that the channels 36*a*, 36*b* accommodate the smallest conductor 60*a* of its range of accommodation, 60*b* diameter; after extrusion, the channels 36*a*, 36*b* may be machined to accommodate conductors 60*a*, 60*b* of larger diameters. Similarly, the second member 40 may be extruded to accommodate the smallest conductors 60*a*, 60*b* and the contact planes 53*a*, 53*b* later machined to accommodate larger conductors 60*a*, 60*b*. Thus, a single extrusion die for each member may accommodate connector assemblies for a wide variety of conductors, and may even accommodate asymmetric sizing in which one channel 36*a* or contact plane 53*a* is machined to a different size than the other channel 36*b* or contact plane 53*b*. The bore 26 in the first member 20 may be machined after extrusion. The bore 26 may be machined after each first member 20 is cut from an extruded bar, or several bores 26 may be machined in the extruded length spaced apart by an appropriate distance before the extrusion is cut to the final length. Since the connector assemblies 10 of varying sizes may be manufactured using relatively simple processes, lead times for executing an order for a given size or sizes of connector assembly 10 may be reduced from the lead time required to custom manufacture conventional C-shaped connectors; further, the simpler process requires less machinery floor space than the manufacture of conventional connectors.

The fastener 70 may be provided with a coating to retard corrosion and/or reduce friction, such as a dry reactive silicate seal. For example, a PLUS® XL top coat may be applied over a GEOMET-L® base coat. Both are available from NOF Metal Coatings North America, Chardon, Ohio 44024. Other appropriate top coats and/or base coats for preventing corrosion and/or that are recognised for torque consistency and lower friction may be used.

Figure 6:
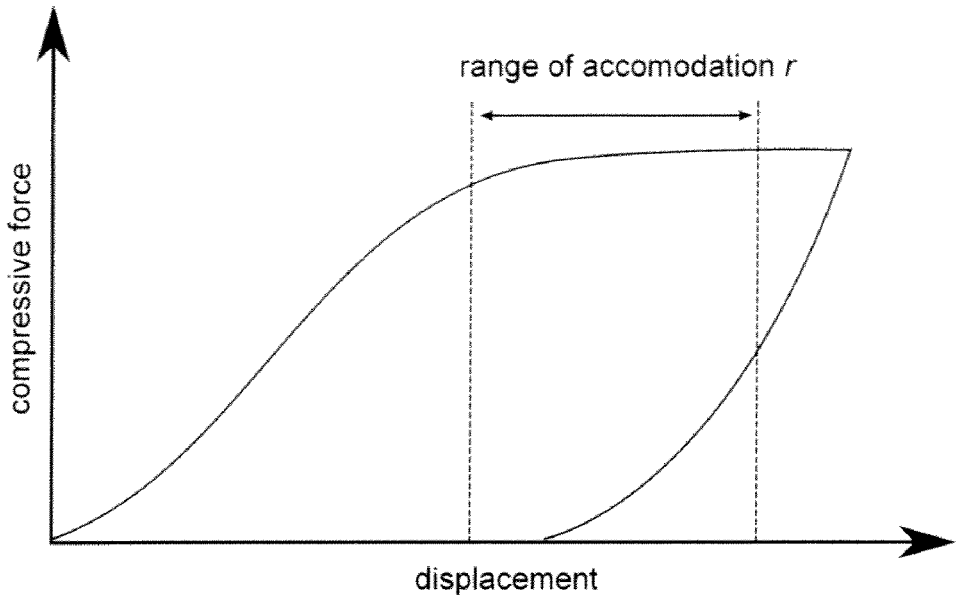
FIG. 6 is a compressive force and displacement graph for the connector assembly of FIG. 1.

To provide a mechanically and/or electrically sound connection, sufficient contact force or cable compression force should be applied to the conductors by the assembly 10 when in the loaded position. For example, cable compression force assists in breaking oxides between cable strand layers of the conductors 60*a*, 60*b* and in establishing and maintaining the required active contact area between the conductors 60*a*, 60*b* and the assembly 10 for the duration of its service life. The fastener 70 must therefore be long enough to push the second member 40 sufficiently away from the body 24 to exert sufficient force on the conductors 60*a*, 60*b* against their respective channels. When sufficient force is exerted by the second member 40, the beams 30*a*, 30*b* and possibly also the body 24 may be deflected by some displacement distance. When this deflection is in the form of elasto-plastic deformation, consistency in the contact force can be achieved over a range of displacement distances identified in the exemplary curve of FIG. 6 as the "Range of Accommodation", r. The lower bound of the range of accommodation r corresponds with the minimum contact force required to form a mechanically and/or electrically sound joint. The upper bound of the range of accommodation is a safe margin below the point beyond which deformation is purely plastic. As will be appreciated by those skilled in the art, manufacturing tolerances should also be taken into account when calculating the range of accommodation r. The range of accommodation is dependent in part on treatment during the manufacturing process of the material with which the connector assembly is made. For example, where the first and second members 20, 40 are formed simply by extrusion of a suitable alloy and heat treated, a wider range of accommodation is possible due to smaller manufacturing tolerances as compared to manufacturing processes for the first and second members 20, 40 that require annealing, heat treating and re-heat treating. Due to this wider range of accommodation, any given size of the connector assembly 10 may be used to apply similar compressive forces on a wider range of sizes of conductors 60*a*, 60*b* (for example, one conductor 60*a* may be a main power line, while the other conductor 60*b* may be a distribution line). As a result, a smaller inventory of differently-sized first and second members 20, 40 can therefore be made to accommodate a given range of conductor sizes than would be required for some other wedge tap connector models. Furthermore, only a few different sized extrusions need be made, particularly where the channels 36*a*, 36*b* and the contact planes 53*a*, 53*b* are machined to accommodate larger conductors. Also, the wider range of accommodation allows the connector assembly 10, once installed and loaded, to be maintained with substantially the same area of contact of the conductor 60*a*, 60*b* with the assembly 10 over time, despite conductor creep due to vibrations, temperature changes, sagging of the conductor 60*a*, 60*b*, or other factors.

As noted above, the first member 20 may be adapted for hot stick applications. As shown in FIG. 1, external face of the body 24 may be provided with flanges 38*a*, 38*b* defining a corresponding recess 39*a*, 39*b*, which receives the hook 92*a*, 92*b* of a hot stick tab 90. The hot stick tab 90 provides a means for a hot stick to grip the connector assembly 10. In the embodiment shown in FIG. 9, the hot stick tab 90 is provided with a bore 94 for receiving the fastener 70 and may have an aperture 98 on the tab portion 96 of the hot stick tab 90 for the hot stick tool to engage. To accommodate the thickness of the hot stick tab 90, the fastener 70 must be longer than would be required for the same embodiment of the assembly 10 without the hot stick tab 90. Thus, in this embodiment, the connector assembly may be assembled in an unloaded position with the hot stick tab 90 and fastener 70, and may be held together with the fastener 70 (holding the hot stick tab 90 and first member 20 together, and possibly also assisting in holding the first and second members 20, 40 together as described above) and the cooperating recesses 23*a*, 23*b* and hooks 44*a*, 44*b*, and/or adhesive (holding the first member 20 and second member 40 together). The first member 20 may be provided with the rib 29 on the tab 28, which may snap-fit into the furrow 47 of the second member (thus holding the first member 20 and second member 40 together). As an alternative to the fastener 70 and/or adhesive holding the hot stick tab 90 and the first member 20 together, the hot stick tab 90 and the first member 20 may be mechanically locked together by any means known in the art. For example, the flanges 38*a*, 38*b* on the first member (as shown in FIG. 1) may be crimped over the hooks 92*a*, 92*b* of the hot stick tab 90, so that they remain attached throughout typical handling of the connector assembly 10. As another example, the longitudinal length of the hot stick tab 90 may be slightly shorter than the length of the flanges 38*a*, 38*b* such that corners of the flanges 38*a*, 38*b* may be mechanically deformed to lock the hot stick tab 90 in place. Thus, the connector assembly 10 may be delivered, substantially assembled, to the field for installation. The connector assembly 10 structure thus eliminates or minimizes the number of loose parts that the installer in the field needs to handle, particularly in extreme weather conditions, consequently reducing installation time.

Figure 10:
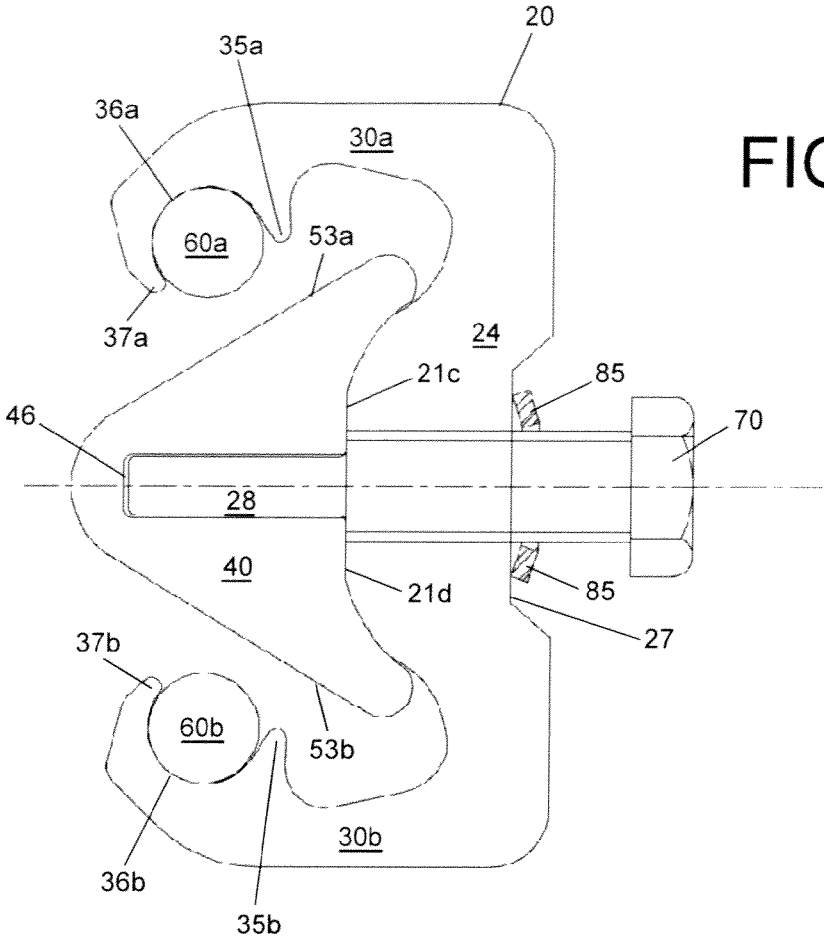
FIG. 10 is a cross-sectional view of a further embodiment of a connector assembly, fastener, and dampening washer.

In a further embodiment, shown in FIG. 10, a further spring member 85 may be provided on the fastener 70, such that it is positioned between the head of the fastener 70 and the first member 20. The further spring member 85 may also be a Belleville washer or otherwise configured to provide for the dampening of vibrations in the connector assembly 10.

Figure 11:
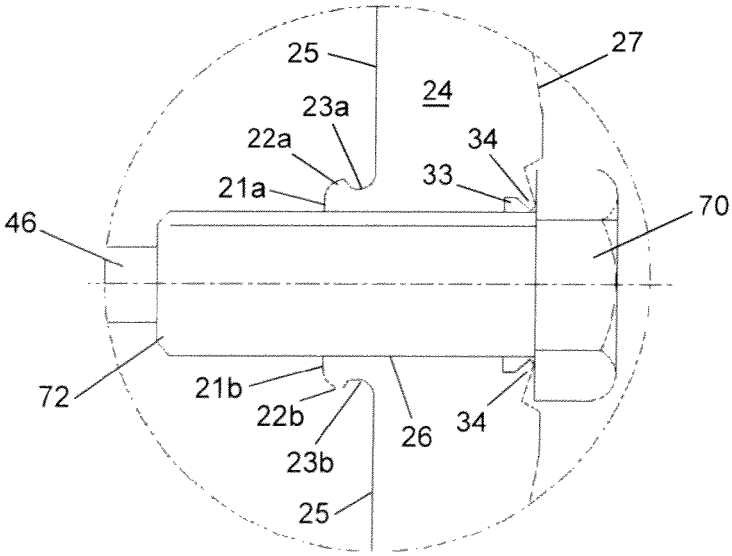
FIG. 11 is a partial cross-sectional view of an embodiment of a fastener-locking first member of the connector assembly of FIG. 2.

The connector assembly 10 may further be provided with a bolt locking feature. Turning to FIG. 11, which provides a partial cross-section of the first member 20 of FIG. 2, a recess 33 is provided in the external surface 27 of the first member 20. Within the recess 33 is defined one or more ridges 34 at an entrance to the recess 33. The recess leads to the bore 26 of the first member 20. As the fastener 70, disposed in the bore 26 of the first member 20, is tightened through the partially loaded position to the loaded position, the ridges 34 are lodged under the head of the fastener 70. If the fastener 70 is a threaded bolt, the ridges 34 may be caught between and deformed against the head of the fastener 70 and the commencements of the threads on the bolt. This interference fit between the fastener 70 and the first member 20 assists in preventing the fastener 70 from loosening due to vibrations or expansions and contractions of the first member 20 and/or fastener 70. A similar bolt locking feature may be provided on the external surface 95 of the hot stick tab 90.

The connector assembly may also be easily adapted for use as an insulation piercing connector (IPC) assembly. FIGS. 12A to 12C illustrate an embodiment of an IPC assembly. At least one piercing insert 110 is provided for each insulated conductor, on at least one of the contact planes 53*a*, 53*b* of the second member 40 and/or at least one of the channels 36*a*, 36*b* of the first member 20. The piercing insert 110 may be integral with the first or second member 20, 40, or alternatively it may be formed separately and mounted onto the first or second member 20, 40. As can be seen in FIG. 12B, the piercing insert may be formed from a metal plate with crimping flanges 112 depending therefrom. One or more piercing bridges 114 may be formed in the insert 110, or may be stamped out of the insert 110 and bent to extend from the conductor-facing surface of the insert 110. The piercing bridges may be provided with teeth, blades, or points for piercing the insulation surrounding a conductor 60*a*, 60*b* so that the teeth, blades or points contact the conductor to establish a conductive path between the conductor and the connector assembly 10 when the connector assembly 10 is in a loaded position. Each piercing insert 110 thereby creates at least one conductive path when the IPC assembly is in the loaded position. If the piercing insert 110 is intended for the channel 36*a*, 36*b*, then the insert 110 may be provided with a contoured surface to generally match the contour of the channel 36*a*, 36*b*. If the piercing insert is manufactured separately, it may be mounted onto the first or second member 20, 40 in any manner known in the art. In the example of FIG. 12C, the crimping flanges 112 are bent, and their ends received into recesses 116 in the first or second member 20, 40. The piercing inserts 110 may thus be applied to the connector assembly 100 in the field immediately prior to installation, if desired.

As wiping is typically not required in IPC assemblies, the angle between the guide planes 50*a*, 50*b* of the second member and the beam 30*a*, 30*b* of the first member 20 may be adjusted to reduce or eliminate wiping.

An enclosure or housing may be used with or without a sealant to protect a connector assembly or an IPC assembly against environmental conditions, particularly those harsh conditions found in coastal applications. As an example, a polyvinyl chloride (PVC) enclosure may provide partial protection against corrosion, while an enclosure provided with sealant may provide full protection against corrosion. The sealant may be a gel, such as silicone.

The connector assembly 10 described above thus provides a solution for connecting electrical conductors that is safe and reliable, can accommodate a range of conductor sizes, can be easily and inexpensively manufactured, and does not require special tooling to install. The configuration of the first and second members 20, 40 facilitates alignment of these two pieces at the installation site. Further, the connector assembly 10 may be shipped in a preassembled, unloaded state with at least the first member 20 and second member 40 temporarily joined or affixed to each other, which facilitates handling and installation in the field. In other embodiments, the connector assembly 10 may be preassembled together with the fastener 70, a washer 80 or 85, and even a hot stick tap 90, which facilitates installation on an energized power line or in poor environmental conditions where visibility may be reduced by precipitation and the like. The preassembly of the connector assembly 10 in this manner, and the ease with which the various pieces may be aligned, provide an advantage over conventional wedge connectors.

Various embodiments of the present invention having been thus described in detail by way of example, it will be apparent to those skilled in the art that variations and modifications may be made without departing from the invention. The invention includes all such variations and modifications as fall within the scope of the appended claims.

What is claimed is:

1. A connector assembly, comprising:

an electrically conductive first member comprising:

a first beam and a second beam, a first face of each of the first beam and second beam being provided with a corresponding channel for receiving a conductor, wherein each of the first beam and second beam extends from a first face of a body of the first member such that the first face of the body is adjacent the first face of each of the first beam and the second beam, and wherein the first face of the first beam and the first face of the second beam are oriented to substantially face each other, and at least one first alignment portion for guiding an electrically conductive second member;

the electrically conductive second member comprising:

at least one second alignment portion adapted to cooperate with the at least one first alignment portion, a body facing surface, a first channel facing surface and a second channel facing surface, wherein when the at least one alignment portion is at least partially mated with the at least one second alignment portion, the second member is movable between an unloaded and a loaded position, wherein in the unloaded position the body facing surface is proximate to the first face of the body, and in the loaded position the body facing surface is spaced apart from the first face of the body, and in the loaded position a conductor disposed in the channel of the first beam is retained in said channel by the first channel facing surface and a conductor disposed in the channel of the second beam is retained in said channel by the second channel facing surface.

2. The connector assembly of claim 1, wherein the first channel facing surface and the second channel facing surface meet at a nose such that, when in the unloaded position, each of the first and second channel facing surfaces are adapted to guide their respective conductors into their respective channels.

3. The connector assembly of claim 1, wherein the first face of the body comprises at least one recess disposed longitudinally along the first member, and further wherein the second member comprises a body facing surface shaped to slidingly fit the at least one recess comprised in the first face of the body for removably joining the first and second members together in the unloaded position.

4. The connector assembly of claim 1, wherein each of the channels provided in the first beam and second beam are angled towards a center of the first member.

5. The connector assembly of claim 1, wherein the first member and the second member are formed from an aluminum alloy.

6. The connector assembly of claim 1, wherein at least one of the channels provided on the first beam or the second beam comprises an insulation piercing member disposed on a surface of the channel contacting a conductor.

7. The connector assembly of claim 1, wherein a conductor-contacting surface of at least one of the first channel facing surface and the second channel facing surface comprises an insulation piercing member.

8. The connector assembly of claim 1, wherein the body facing surface and the first face of the body are removably affixed to each other with an adhesive.

9. The connector assembly of claim 1, wherein the first and second members are slide-fit together in the unloaded position.

10. The connector assembly of claim 1, wherein the at least one first alignment portion comprises at least one tab extending substantially perpendicularly from the first face of the body, and the at least one second alignment portion comprises at least one corresponding slot provided in the body facing surface and adapted to receive the at least one tab.

11. The connector assembly of claim 10, wherein the at least one tab comprises at least one rib, and further wherein the at least one slot comprises at least one furrow corresponding to said at least one rib, such that the first and second member may be removably snap-fit together.

12. The connector assembly of claim 10, wherein the first member substantially comprises a Sigma or E cross-sectional profile.

13. The connector assembly of claim 10, wherein the first member is symmetric around a plane extending longitudinally along the first member along an axis of the bore comprised in the first member, and the second member is symmetric around a plane extending longitudinally along the second member along an axis of the slot comprised in the second member.

14. The connector assembly of claim 1, wherein the first member comprises a bore for receiving a fastener, the bore extending from the first face of the body to an opposing face of the body, such that the connector assembly is movable from the unloaded position to the loaded position by inserting the fastener in the bore from the opposing face of the body and advancing the fastener in the bore such that force is applied by a tip of the fastener onto the body facing surface of the second member, and the first channel facing surface and second channel facing surface are advanced towards the channel of the first beam and the second beam, respectively.

15. The connector assembly of claim 14, further comprising a spring member disposed between the tip of the fastener and the body facing surface, such that the force applied by the tip of the fastener is transmitted via the spring member to the body facing surface of the second member.

16. The connector assembly of claim 14, further comprising the fastener, wherein the fastener comprises a bolt, a length of the bolt being selected such that the connector assembly is in the loaded position when a head of the bolt abuts the opposing face of the body.

17. The connector assembly of claim 16, further comprising a spring member disposed between the head of the bolt and the opposing face of the body.

18. The connector assembly of claim 16, wherein the opposing face of the body comprises at least one ridge adapted to engage in a compression fit between the head and a thread of the bolt when the bolt is advanced to place the connector assembly in the loaded position.

19. The connector assembly of claim 14, wherein the opposing face of the body comprises at least one recess disposed longitudinally along the opposing face of the body, the connector assembly further comprising a hot stick tab adapted to be mounted on a hot stick, the hot stick tab comprising at least one flange shaped to be slidingly fit in the at least one recess on the opposing face of the body, the hot stick tab further comprising a bore for receiving the fastener, such that when the hot stick tab and the first member are slidingly engaged, the bore of the hot stick tab is aligned with the bore of the first member.

20. The connector assembly of claim 10, further comprising the fastener, wherein the fastener comprises a bolt, a length of the bolt being selected such that the connector assembly is in the loaded position when a head of the bolt abuts an external surface of the hot stick tab and wherein the external surface of the hot stick tab comprises at least one ridge adapted to engage in a compression fit between the head and a thread of the bolt when the bolt is advanced to place the connector assembly in the loaded position.

21. The connector assembly of claim 19, wherein the body facing surface and the first face of the body are removably affixed to each other, and the hot stick tab is affixed to the first member.

* * * * *